US006341497B2

(12) United States Patent
Herrick et al.

(10) Patent No.: US 6,341,497 B2
(45) Date of Patent: Jan. 29, 2002

(54) MOTOR REVERSAL SWITCHING SYSTEM

(75) Inventors: Kent B. Herrick, Saline; Arnold G. Wyatt, Jackson, both of MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/883,562

(22) Filed: Jun. 18, 2001

Related U.S. Application Data

(62) Division of application No. 09/468,468, filed on Dec. 21, 1999.

(51) Int. Cl.[7] ..... F25B 49/00
(52) U.S. Cl. ..... 62/228.3; 62/226
(58) Field of Search ..... 62/228.3, 115, 62/228.1, 228.5, 226

(56) References Cited

U.S. PATENT DOCUMENTS

| | | | | |
|---|---|---|---|---|
| 2,894,384 A | | 7/1959 | Smith | 68/12 |
| 4,143,995 A | | 3/1979 | Divisi | 417/3 |
| 4,243,920 A | | 1/1981 | Brehm | 318/285 |
| 4,248,053 A | | 2/1981 | Sisk | 62/158 |
| 4,646,535 A | * | 3/1987 | Matsuoka et al. | 62/228.3 |
| 4,689,533 A | | 8/1987 | Yang | 318/281 |
| 4,808,078 A | | 2/1989 | Havens et al. | 417/38 |
| 4,843,834 A | * | 7/1989 | Inoue et al. | 62/284.3 |
| 4,860,549 A | * | 8/1989 | Murayma | 62/115 |
| 4,897,882 A | | 1/1990 | Pickering | 388/801 |
| 5,130,624 A | | 7/1992 | Bashark | 318/280 |
| 5,285,646 A | | 2/1994 | Taeduk | 62/115 |
| 6,172,476 B1 | * | 1/2001 | Tolbert, Jr. et al. | 62/284.4 |

FOREIGN PATENT DOCUMENTS

| | | |
|---|---|---|
| RU | SU-827-843 | 7/1981 |

* cited by examiner

*Primary Examiner*—William E. Tapolcai
*Assistant Examiner*—Mohammad M Ali
(74) *Attorney, Agent, or Firm*—Baker & Daniels

(57) ABSTRACT

The present invention involves a reversible, dual capacity compressor system. The compressor systems includes a reversible compressor, a pressure sensor, and a control assembly. The reversible compressor operates at a first capacity when the compressor rotates in a first direction and at a second and lesser capacity when the compressor rotates in a second direction. The pressure sensor is coupled to the compressor and generates a high pressure signal and a low pressure signal. The control assembly is coupled to the compressor and the pressure sensor and controls the compressor to rotate in the first direction when receiving a high pressure signal from the pressure sensor and to rotate in the second direction when receiving a low pressure signal from the pressure sensor.

16 Claims, 5 Drawing Sheets

MOTOR REVERSAL SWITCHING SYSTEM

CROSS-REFERENCE TO RELATED APPLICATION

This is a Division of patent application Ser. No. 09/468,468, filed Dec. 21, 1999.

BACKGROUND OF THE INVENTION

1. Field of the Invention

The present invention relates to a device for controlling a compressor, and more particularly to an apparatus for controlling a compressor for reversible, dual capacity operation.

2. Description of the Related Art

Economic advantages are provided in the operation of an air conditioning system if the system is capable of operating efficiently at a lowered volumetric displacement on mild days and at a higher volumetric displacement on hot days. Running the system at a lower capacity reduces the power consumption and increases the life of the system.

Typically, multiple compressors or a single dual capacity compressor have been used for this situation. The dual capacity compressor operates two pistons in the forward direction and one piston in the reverse direction. Examples of such a compressor is disclosed in U.S. Pat. No. 4,248,503 and allowed patent application 09/099,013, which are expressly incorporated by reference. A reversible compressor motor is used to run the compressor in the forward or reverse direction. Typically, capacity choice is controlled by a standard mechanical or electronic two stage thermostat.

SUMMARY OF THE INVENTION

The present invention in one form thereof involves a device for controlling a reversible compressor. The device provides a microprocessor-based control circuit including a pressure switch that differentiates between high and low load conditions and generates a control signal representing such conditions. During high load conditions the motor is controlled to rotate the compressor in the forward direction using dual cylinders and during low load conditions to rotate the compressor in the reverse direction using a single cylinder. The switchover occurs with the compressor at rest and start against equalized pressure, a time delay is introduced to effect this. During the time delay induced off time, a signal is generated to energize a relay to effectuate a switch in the wiring to allow direction reversal.

The present invention provides a reversible, dual capacity compressor system. The system comprises a reversible compressor, a pressure sensor coupled to the compressor, and a control assembly electrically coupled to the compressor and the pressure sensor. The reversible compressor operates at a first capacity when the compressor rotates in a first direction and at a second capacity when the compressor rotates in a second direction. The first capacity is greater than the second capacity. The pressure sensor generates a high pressure signal and a low pressure signal, whereby a high pressure signal indicates a high load condition and a low pressure signal indicates a low load condition. The control assembly controls the compressor to rotate in the first direction when receiving the high pressure signal from the pressure sensor and to rotate in the second direction when receiving the low pressure signal from the pressure sensor.

An advantage of the present invention is that a single stage thermostat can be used to control life reversible compressor.

BRIEF DESCRIPTION OF THE DRAWINGS

The above mentioned and other features and objects of this invention, and the manner of attaining them, will become more apparent and the invention itself wil be better understood by reference to the following description of an embodiment of the invention taken in conjunction with the accompanying drawings, wherein.

Corresponding reference characters indicate corresponding parts throughout the several views. The exemplification set out herein illustrates an embodiment of the invention, in one form, and such exemplification is not to be construed as limiting the scope of the invention in any manner.

DESCRIPTION OF THE PRESENT INVENTION

Figure 1:
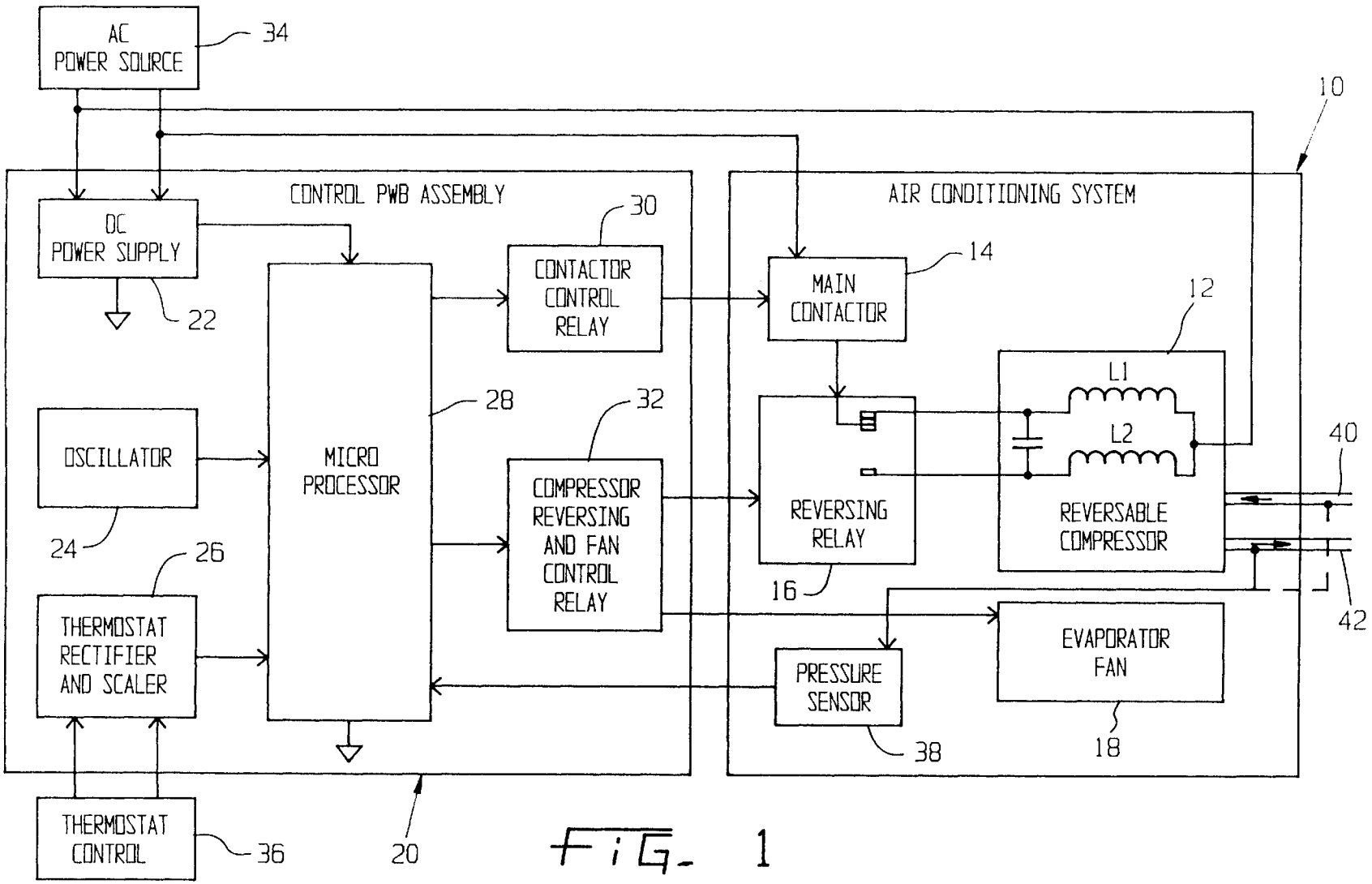
FIG. 1 is a block diagram of an air conditioning system with the motor reversal switching system of the present invention.

Referring to FIG. 1 there is shown an air conditioning system in accordance with the present invention which includes air conditioning unit 10, control circuit 20, AC power source 34, and thermostat control 36. Air conditioning unit 10 includes reversible compressor 12, main contactor 14 for controlling AC power to compressor 12, reversing relay 16 for controlling direction of rotation of compressor 12, evaporator fan 18, and pressure sensor 38 located on suction line 40 or discharge line 42 of compressor 12. The dotted line connection indicates an alternate connection of the pressure sensor to the compressor. Control circuit board 20 includes DC power supply 22, oscillator 24, thermostat rectifier and scaler 26, microprocessor 28, contactor control relay 30, and compressor reversing and fan control relay 32.

Figure 2A:
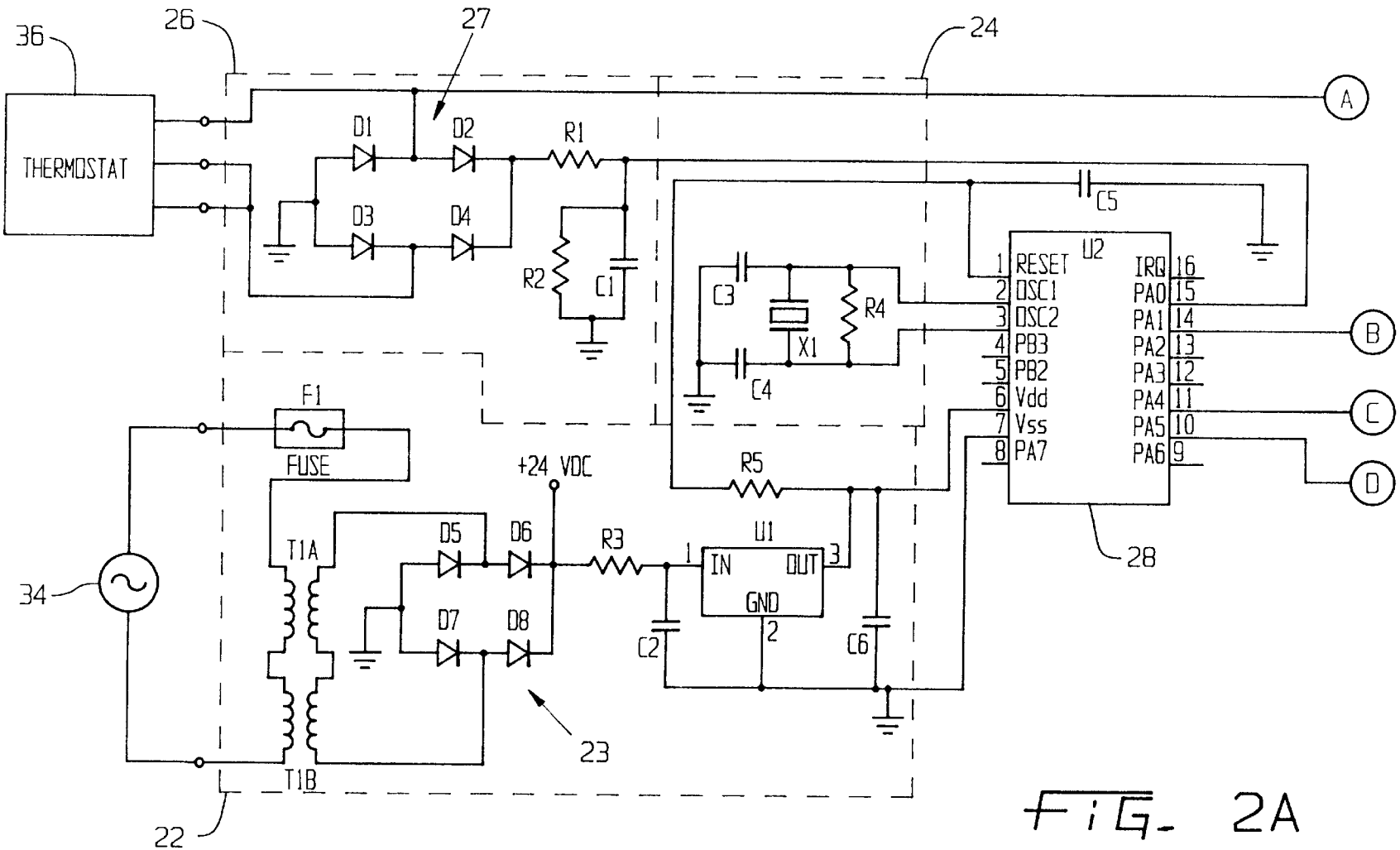
FIGS. 2A and 2B are a schematic diagram thereof.
Figure 2B:
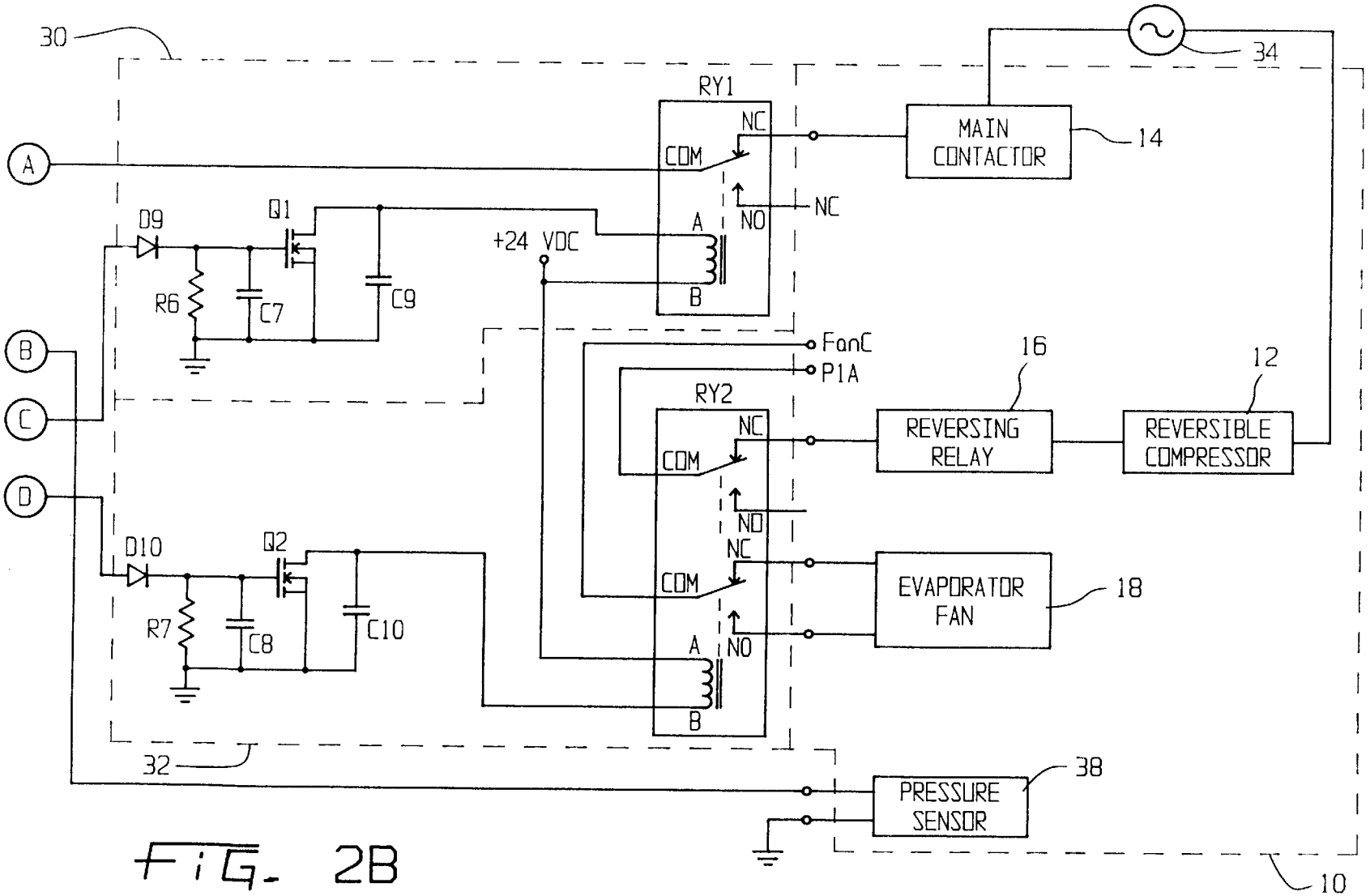

Referring now to FIGS. 2A and 2B, DC power supply 22 receives AC power from source 34 through fuse F1 and converts the AC power to 24 VDC using transformer TX1 and rectifier bridge 23 comprised of diodes D5, D6, D7, D8. The 24 VDC is supplied to relays RY1, RY2. The 24 VDC is then converted to 5 VDC using RC filter R3, C2 and voltage regulator U1. The 5 VDC is supplied to microprocessor 28.

Thermostat rectifier and scaler circuit 26 receives an input of 0 or 28 AC volts from thermostat control 36 and converts that input to a thermostat signal for microprocessor 28 pin 15 using rectifier bridge 27 comprised of diodes D1, D2, D3, D4 and a scaler comprised of resistors R1, R2 and capacitor C1. The thermostat signal is a logic low when the thermostat is on and a logic high when the thermostat is off.

Contactor control relay circuit 30 includes diode D9, resistor D9, capacitors C7, C9, transistor Q1, and relay RY1. Circuit 30 is controlled by the output on pin 11 of microprocessor 28. A logic high on microprocessor 28 pin 11 turns on transistor Q1 allowing current to flow through the coil of relay RY1 pulling the connection of COM of NO, which opens main contactor 14. A logic low on microprocessor 28 pin 11 turns off transistor Q1 stopping the flow of current through the coil of relay RY1 and connecting the COM to NC, which the closes main contactor 14.

Compressor reversing and fan control relay circuit 32 includes diode D10, resistor R7, capacitors C8, C10, transistor Q2, and relay RY2. Circuit 32 is controlled by the output on pin 10 of microprocessor 28. A logic high on microprocessor 28 pin 10 turns on transistor Q2 allowing current to flow through the coil of relay RY2 pulling the connection of the pair of COMs to the NOs, which turn evaporator fan 18 to low and switches reversing relay 16 to the position of placing compressor 12 in low capacity or reversed mode. A logic low on microprocessor 28 pin 10 turns off transistor Q2 stopping the flow of current through the coil of relay RY2 connecting the pair of COMs to the NCs, which turn evaporator fan 18 to high and switches reversing relay 16 to the position of placing compressor 12 in high capacity or forward mode.

Microprocessor 28 controls air conditioning unit 10 inputs from thermostat rectifier and scaler 26 and pressure sensor 38. Oscillator 24 comprises capacitors C3, C4, resistor R4, and crystal X1 and supplies a 1 MHz clock to microprocessor 28. Pressure sensor 38 supplies a pressure sensor signal to pin 14 of microprocessor 28. A high pressure signal indicates a high load condition and a low pressure signal indicates a low load condition. Microprocessor 28 uses the start up routine in FIG. 3 to initialize air conditioning unit 10 and the operating routine in FIG. 4 to run air conditioning unit 10.

Figure 3:
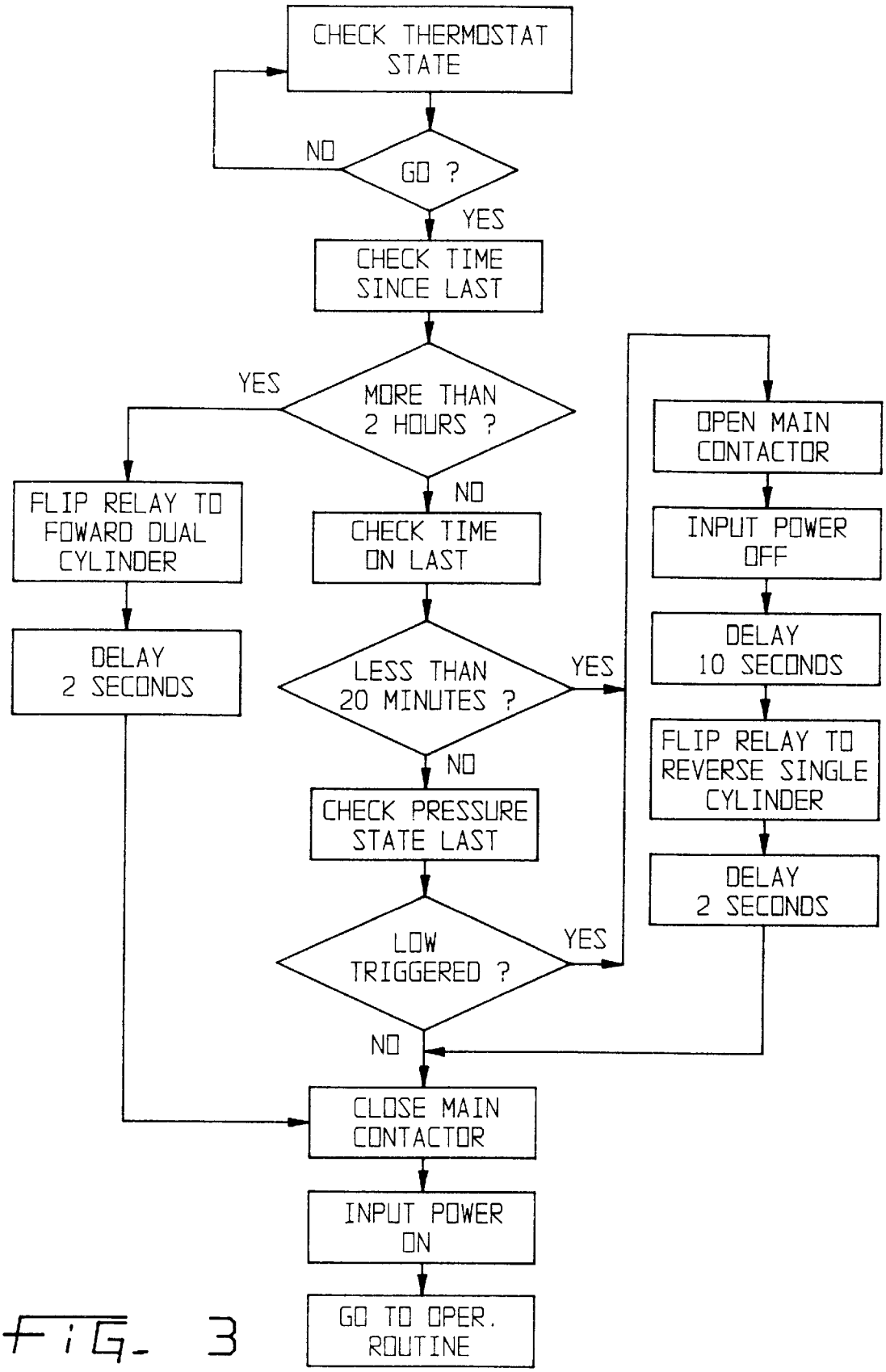
FIG. 3 is a flow chart illustrating the start up routine of the system.
Figure 4:
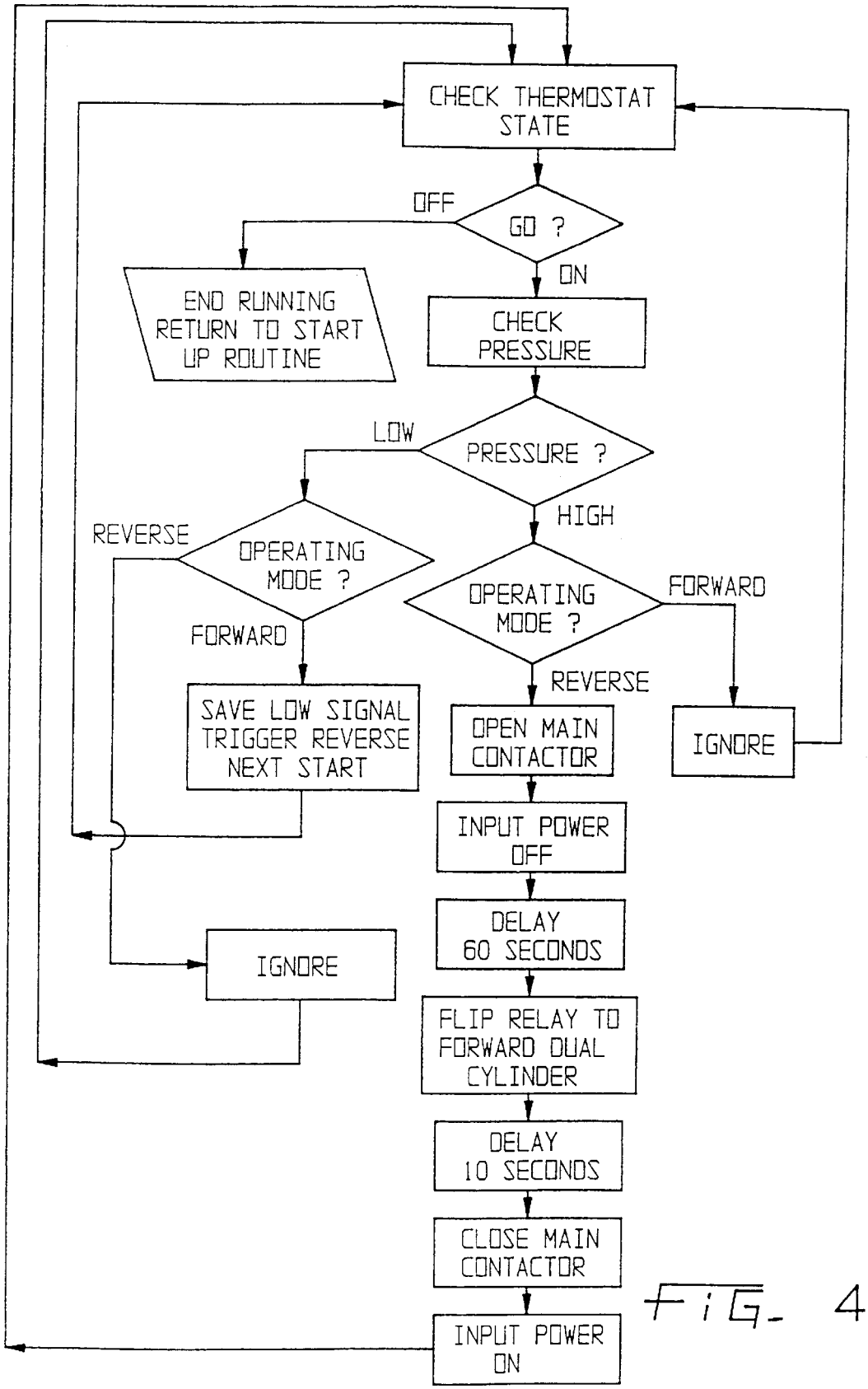
FIG. 4 is a flow chart illustrating the operating routine of the system.

The routines in FIGS. 3 and 4 show the control of the operating mode of the compressor. The compressor is operated in the high capacity mode when the thermostat has been off for more than a predetermined period of time, such as two hours for example, or the compressor last ran for more a predetermined period of time, such asthan twenty minutes and the compressor was last run in a high capacity mode. The two hours of off time represent a sufficient period of time for the temperature in the room to have risen significantly. The twenty minutes of run time represent a substantial amount of time to lower the temperature in the room. The compressor is operated in the low capacity mode when the thermostat has been off for less than two hours and the compressor last ran for less than twenty minutes or the compressor last ran for more than twenty minutes and the last checked pressure state was low or the compressor was last run in low capacity mode. The low capacity mode allows the compressor to operate more economically when the load requirements are low by reducing power consumption and improving the life of the compressor. The evaporator fan is also operated at low speed with the compressor in low capacity mode and at high speed with the compressor in high capacity mode. Different periods of time may be set into the microprocessor, if desired.

Referring now to FIG. 3, the start up routine begins by checking the state of the thermostat signal on pin 15 of microprocessor 28. If the thermostat signal is a logic high, then the start up routine continues to monitor the thermostat signal. If the thermostat signal is a logic low, then the time since last run is calculated.

If the time since last run is greater than two hours, then microprocessor 28 pin 10 is set to a logic low placing compressor 12 in high capacity or forward mode and fan 18 to high. After a wait of two seconds, microprocessor 28 pin 11 is set to a logic low closing main contactor 14 and supplying power to compressor 12. The start up routine then passes control to the operating routine.

If the time since last run is less than two hours, then the last run time is calculated. If the last run time is greater than twenty minutes, then the low pressure trigger is checked. If the low pressure signal trigger is a logic low, then microprocessor 28 pin 11 is set to a logic low closing main contactor 14 and supplying power to compressor 12. The start up routine then passes control to the operating routine. Compressor 12 and fan 18 remain in their last running state.

If the low pressure signal trigger is a logic high, then microprocessor 28 pin 11 is set to a logic high operating main contactor 14 and removing power from compressor 12. After a wait of ten seconds, microprocessor 28 pin 10 is set to a logic high placing compressor 12 in low capacity or reverse mode and fan 18 to low. After a wait of two seconds, microprocessor 28 pin 11 is set to a logic low closing main contactor 14 and supplying power to compressor 12. The start up routine then passes control to the operating routine.

If the last run time is less than twenty minutes, then microprocessor 28 pin 11 is set to a logic high opening main contactor 14 and removing power from compressor 12. After a wait of ten seconds, microprocessor 28 pin 10 is set to a logic high placing compressor 12 in low capacity or reverse mode and fan 18 to low. After a wait of two seconds, microprocessor 28 pin 11 is set to a logic low closing main contactor 14 and supplying power to compressor 12. The start up routine then passes control to the operating routine.

Referring now to FIG. 4, the operating routine begins by checking the state of the thermostat signal. If the thermostat signal is a logic high, then microprocessor 28 pin 11 is set to a logic high opening main contactor 14 removing power from compressor 12, and the operating routine returns control to the start up routing. If the thermostat signal is a logic low, then the pressure sensor on pin 14 of microprocessor 28 is checked.

If the pressure sensor signal is a logic high indicating high pressure and microprocessor 28 pin 10 is a logic low indicating compressor 12 in high capacity or forward mode, the operating routine returns to its beginning and checks the thermostat signal.

If the pressure sensor signal is a logic high indicating high pressure and microprocessor 28 pin 10 is a logic high indicating compressor 12 in low capacity or reverse mode, then microprocessor 28 pin 11 is set to a logic high opening main contactor 14 and removing power from compressor 12. After a wait of sixty seconds, microprocessor 28 pin 10 is set to a logic low placing compressor 12 in high capacity or forward mode and fan 18 to high. After a wait of ten seconds, microprocessor 28 pin 11 is set to a logic low closing main contactor 14 and supplying power to compressor 12. The operating routine then returns to its beginning and checks the thermostat signal.

If the pressure sensor signal is a logic low indicating low pressure and microprocessor 28 pin 10 is a logic high indicating compressor 12 in low capacity or reverse mode, the operating routine returns to its beginning and checks the thermostat signal.

If the pressure sensor signal is a logic low indicating low pressure and microprocessor 28 pin 10 is a logic low indicating compressor 12 in high capacity or forward mode, then the low signal trigger is set to a logic high for placing compressor 12 in low capacity or reverse mode during the next start up.

While this invention has been described as having an exemplary design, the present invention may be modified within the spirit and scope of this disclosure. This application is therefore intended to cover any variations, uses, or adaptations of the invention using its general principles. Further, this application is intended to cover such departures from the present disclosures as come within known or customary practice in the art to which this invention pertains. For example, the present invention has been described herein with certain time values. Those skilled in the art will recognize, however, that other time values may be used, typically dependent in large part upon the particular application and assign goals, without departing from the scope of the present invention.

What is claimed is:

1. A reversible, dual capacity compressor system, comprising:

a reversible compressor, said compressor operating at a first capacity when said compressor rotates in a first direction and at a second capacity when said compressor rotates in a second direction;

a pressure sensor fluidly coupled to one of compressor discharge or suction pressure; and a compressor direction control assembly electrically coupled to said compressor and said pressure sensor and responsive to an input from said pressure sensor.

2. The system of claim 1, wherein said pressure sensor generates a high pressure signal and a low pressure signal, whereby said high pressure signal indicates a high load condition and said low pressure signal indicates a low load condition.

3. The system of claim 2, wherein said control assembly causes said compressor to rotate in said first direction when receiving said high pressure signal and to rotate in said second direction when receiving said low pressure signal.

4. The system of claim 1, wherein said first capacity is greater than said second capacity.

5. The system of claim 1, wherein said control assembly includes a microprocessor, said microprocessor includes means to control said reversible compressor depending on the input from said pressure sensor.

6. The system of claim 5, wherein said microprocessor includes means to delay starting said compressor, whereby said compressor starts against equalized pressure.

7. The system of claim 1, further comprising a reversing relay electrically coupled to said compressor.

8. The system of claim 7, wherein said control assembly includes a compressor reversing control relay, said compressor reversing control relay coupled to said reversing relay.

9. The system of claim 8, further comprising a two speed evaporator fan for electrically coupled to said compressor reversing control relay and controlled to correspond to compressor operating direction.

10. The system of claim 1, further comprising a main contactor electrically coupled to said compressor and said control assembly includes a contactor control relay electrically coupled to said main contactor.

11. The system of claim 1, further comprising a thermostat coupled to said control assembly, said control assembly includes a thermostat rectifier and scaler, said thermostat rectifier and scaler electrically coupled to said thermostat, said control assembly includes means to control said compressor depending on an input from said thermostat.

12. A reversible, dual capacity compressor system, comprising:

an AC power source;

a reversible compressor, said compressor operating at a first capacity when said compressor rotates in a first direction and at a second capacity when said compressor rotates in a second direction;

a reversing switch electrically coupled to said AC power source and said reversible compressor;

a pressure sensor fluidly coupled to one of a discharge or suction line of said compressor; and a control assembly electrically coupled to said AC power source, said reversing switch and said pressure sensor, said control assembly including a microprocessor electrically coupled to said reversing switch and said pressure sensor, said microprocessor including means to control said reversible compressor depending on an input from said pressure sensor.

13. The system of claim 12, wherein said microprocessor includes means to delay starting said compressor, whereby said compressor starts against equalized pressure.

14. The system of claim 12, wherein said reversing switch is a relay, and further comprising a main contactor electrically coupled to said AC power source and said reversing relay and said control assembly includes a contactor control relay electrically coupled to said main contactor.

15. The system of claim 12, further comprising a thermostat coupled to said control assembly and said control assembly includes a thermostat rectifier and scaler, said thermostat rectifier and scaler electrically coupled to said thermostat.

16. The system of claim 15, wherein said control assembly includes means to control said compressor depending on an input from said thermostat.

* * * * *